United States Patent [19]

McKirnan

[11] 4,130,220

[45] Dec. 19, 1978

[54] TAMPERPROOF COVER

[75] Inventor: Robert A. McKirnan, Winnetka, Ill.

[73] Assignee: Knight Engineering & Molding Company, Arlington Heights, Ill.

[21] Appl. No.: 803,520

[22] Filed: Jun. 6, 1977

Related U.S. Application Data

[63] Continuation-in-part of Ser. No. 732,098, Oct. 13, 1976, abandoned.

[51] Int. Cl.[2] ..... B65D 43/10

[52] U.S. Cl. ..... 220/284; 220/85 P; 220/306; 222/182

[58] Field of Search ..... 220/85 P, 284, 306; 222/182

[56] References Cited

U.S. PATENT DOCUMENTS

| | | | |
|---|---|---|---|
| 2,707,968 | 5/1955 | Efford | 220/85 P |
| 3,334,769 | 8/1967 | Gach | 220/284 |
| 3,358,875 | 12/1967 | Ekstrom | 220/307 |
| 3,514,011 | 5/1970 | Maderia | 220/85 P |
| 3,515,307 | 6/1970 | Gach | 222/182 |
| 3,532,249 | 10/1970 | Gach | 220/284 |
| 3,870,187 | 3/1975 | Bennett | 220/85 P |

*Primary Examiner*—George E. Lowrance
*Attorney, Agent, or Firm*—Kinzer, Plyer, Dorn & McEachran

[57] ABSTRACT

A removable and replaceable cover for a container of the type having a cylindrical mounting cup with a peripheral undersurface defined by a peripheral outer edge located near the outlet end of the container. The cover is tamperproof until its first removal after which time it functions as a child resistant safety cover. The cover includes a top wall, a relatively thin flexible outer sleeve depending from the top wall and a relatively thin flexible inner sleeve which is generally coaxial with the outer sleeve and also depends from the top wall. Located at the lower end of the inner sleeve is an inwardly projecting locking flange which is adapted to extend under the peripheral undersurface of the container when the cover is installed on the container. The locking flange is trapezoidal in cross section with its shorter end extending inwardly of the peripheral outer edge of the container mounting so that at least a portion of the locking flange is removable by the peripheral outer edge of the undersurface when the cover is removed from the container the first time. A lifting pad is formed on the outer surface of the outer sleeve just above the lower edge of the sleeve. At least one web connects the inner and outer sleeves with the web located adjacent the lifting pad. Ribs are positioned on opposite sides the lifting pad and extend downwardly from the lifting surface thereof to the lower edge of the outer sleeve.

6 Claims, 9 Drawing Figures

TAMPERPROOF COVER

This is a continuation-in-part of my application Ser. No. 732,098 filed Oct. 13, 1976, now abandoned.

BACKGROUND AND SUMMARY OF THE INVENTION

Tamperproof covers are used on containers, particularly aerosol containers, to prevent prospective customers, especially customers in self-service stores from opening the containers prior to purchase. Many different types of tamperproof containers have been used. For example, Edelstone et al., U.S. Pat. No. 3,149,745, shows a double shell cover having an inner sleeve 26 with a locking ring 28 at the lower end thereof. The locking ring fits over and attaches to an undersurface 21 of a mounting cup 20 formed on the aerosol container. The locking ring 28 is split and can be released from engagement with the undersurface 21 by the use of a key, a screwdriver or other elongated implement inserted through an opening 31 in the outer sleeve. The elongated object engages and spreads lugs 30 located on opposite sides of the split in the inner sleeve. A seal 32 fits over the opening 31 in the outer sleeve of the cover. Since this cover can be opened by a key, an item normally carried by a prospective purchaser, it can easily be opened before purchase even though tampering with the seal 32 will be apparent. Further, there is a danger of puncturing the domed top of the aerosol container if a key, screwdriver or other elongated implement is inserted through the opening 31 in the outer sleeve of the cover.

Gach U.S. Pat. Nos. 3,515,307 and 3,532,249 also show tamperproof covers which, for removal, require the insertion of a screwdriver or other elongated implement through an opening in the outer wall of a double-wall cap with the tip of the screwdriver contacting the dome of the aerosol can and used as a lever. These covers include inner sleeves with locking flanges. Ribs connect the inner and outer sleeves. The use of a screwdriver or other elongated implement in the manner taught by these patents can lead to puncturing of the aerosol container and all of the adverse consequences attendant thereto.

Gach U.S. Pat. No. 3,334,769, shows a tamperproof cover of the single sleeve type in which a lifting pad is located on the outer surface of the cover. This cover relies on a locking means carried by the cover which fits in a groove 24 below the mounting cup of the aerosol container.

A destructible non-replaceable tamperproof cover is shown in Vollers U.S. Pat. No. 3,460,708. This cover has a segmented inner sleeve 22 with each segment having an inwardly projecting lip 24 which engages the undersurface of the mounting cup 14 of the aerosol container. To remove this cover, a screwdriver or other prying instrument is inserted through a notch 25 in the outer wall of the cap. Upon prying, one or more of the segments 22 of the inner sleeve will fracture. This cover is not being replaceable. It also requires the insertion of a screwdriver or prying device into the cover where it may puncture the dome of the aerosol container.

Many of the disadvantages of the above described tamperproof aerosol covers were overcome by the aerosol cover described in Richard H. Bennett U.S. Pat. No. 3,870,187, assigned to the assignee of this invention. The Bennett cover is a double sleeve cover with the sleeves connected by spaced ribs or webs 11. In the embodiment of the invention, shown in FIGS. 1 to 3 of the Bennett patent, the cover must be removed from the container through the use of a screwdriver, key or coin inserted between the outer rim 3 of the aerosol container and the circumferential flange 13 formed on the outer sleeve 9 of the cover. The skirt portion 14 of the outer sleeve extending below the flange 13 protects the domed portion 5 of the aerosol container against puncture by the screwdriver, key or coin. The cover of the embodiment of FIGS. 1 through 3 of the Bennett patent presented some problems in fit since the locking flange 12 was not easily adjustable to compensate for variances in the diameters of the mounting cups of aerosol containers. The adjustment problem was solved by the provision of a slit 15 in the inner sleeve of the cover as shown in the embodiment of FIG. 4 of the Bennett patent. Variations in the length of the slit will vary the tightness of the fit of the locking flange without requiring changes in the amount of undercut of the locking flange. The combination of ribs and a slit also permitted the cover of the Bennett patent to be used as a child resistant cover which could be removed by squeezing pressure applied to the outer wall of the cover combined with a concurrent upward or withdrawal action. However, this reduces somewhat the effectiveness of this cover as a tamperproof cover.

An object of this invention is to provide a tamperproof cover which functions as a child resistant cover when it is reinstalled on a container after its initial removal.

Another object of this invention is to provide a tamperproof cover which can be easily mounted on containers having mounting cups of slightly varying dimensions while still providing a tamperproof cover which cannot originally be removed solely by squeezing and manual manipulation of the cover.

Another object of this invention is a tamperproof cover which protects the container from accidental puncturing by the removal implement.

Another object is a tamperproof cover which is difficult, if not impossible, to remove with a coin or key in which requires an implement of the size and length of a screwdriver.

BRIEF DESCRIPTION OF THE DRAWINGS

The invention is illustrated more or less diagrammatically in the following drawings wherein:

FIG. 5 is a partial cross sectional elevational view of another form of tamperproof cover of this invention mounted on an aerosol container;

FIG. 6 is a side elevational view of the cover of FIG. 5;

FIG. 7 is a top plan view of the cover of FIG. 5;

FIG. 8 is a bottom plan view of the cover of FIG. 5; and

FIG. 9 is an enlarged partial cross sectional view of the locking flange of the cover of FIG. 5.

DESCRIPTION OF THE PREFERRED EMBODIMENTS

Figure 1:
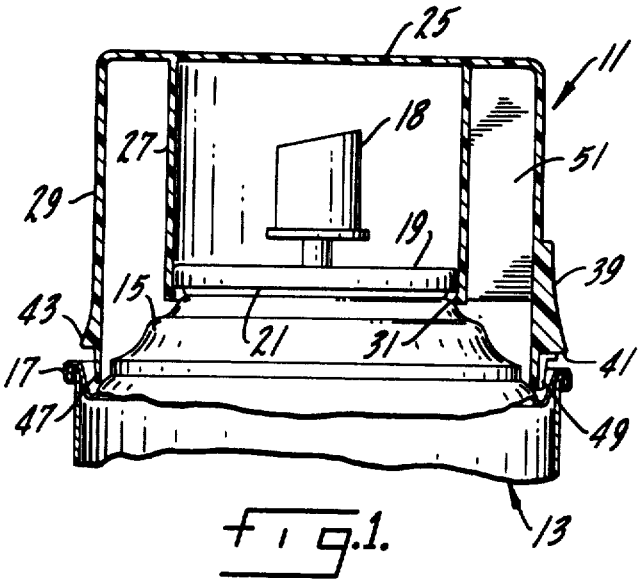
FIG. 1 is a partial cross sectional elevational view of one form of tamperproof cover of this invention installed on an aerosol container.
Figure 2:
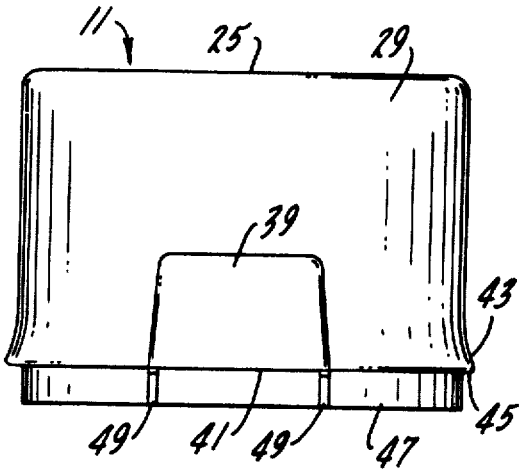
FIG. 2 is a side elevational view of the cover of FIG. 1.
Figure 3:
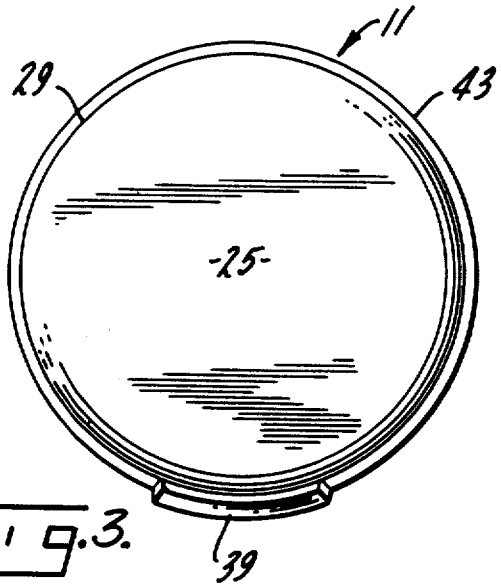
FIG. 3 is a top plan view of the cover of FIG. 1.
Figure 4:
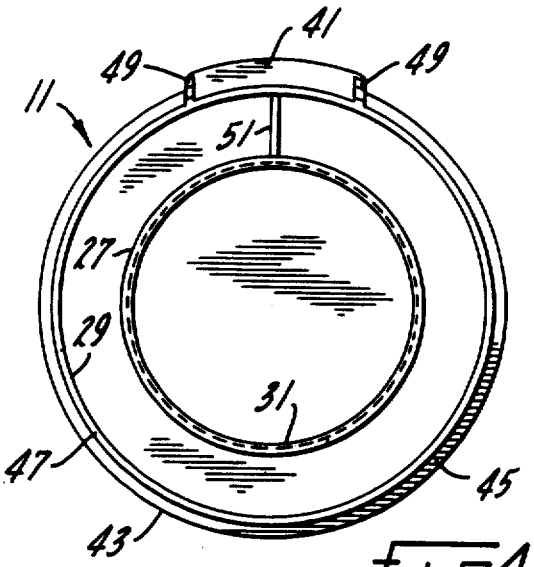
FIG. 4 is a bottom plan view of the cover of FIG. 1.

FIG. 1 of the drawings shows a tamperproof cover 11 of one embodiment of this invention applied to a container 13. In this example, the container 13 is of the aerosol type and is cylindrical in shape. The container is enclosed in its upper end by a domed top wall 15 secured thereto by an upstanding annular rim 17. A valve actuator 18 is mounted on the domed top and is surrounded by an annular collar or mounting cup 19. The annular collar or mounting cup has an undersurface 21 which is spaced above the domed roof.

The tamperproof cover 11 is formed of a suitable resilient and flexible plastic such as polypropylene or an olefin having suitable memory characteristics. The cover may be formed in one piece by a suitable injection molding process.

The cover 11 includes a circular top wall 25 having inner and outer tubular walls or sleeves 27 and 29, respectively, depending therefrom. The inner tubular wall is shorter than the outer tubular wall. An inwardly projecting locking flange or lip 31 is formed at the lower edge of the inner sleeve 27. In this embodiment, the locking flange 31 extends around the entire circumference of the inner sleeve 27. However, it should be understood that the arc of this flange may be shortened, if desired. Also, the locking flange may be formed in two or more segments which are generally positioned diametrically of each other. The inside diameter of the inner sleeve 27 is dimensioned to be less than the mean outside diameter of the mounting cup 29 in the area where the inner sleeve contacts the mounting cup when the locking flange 31 engages the undersurface 21 of the mounting cup. This difference in diameters creates an interference fit. The interference fit should be a minimum of 0.05 inch. This prevents the cover from easily turning when mounted on the container.

A lifting pad 39 is formed integrally on the outer surface of the outer sleeve 29. The lifting pad includes a lifting surface 41 at the base of the pad which surface is located above the lower edge of the outer sleeve. A circumferentially extending flange 43 is formed integrally with and on the outer surface of the outer sleeve 29. The flange 43 includes a planar undersurface 45 which is perpendicular to the surface of the outer sleeve and is located on the same plane as the lifting surface 41 of the lifting pad. A skirt portion 47 of the outer sleeve extends below the surfaces 41 and 45 and is tapered to the lower end of the outer sleeve. Inverted generally L-shaped ribs 49 are formed integrally on the outer surface of the tapered skirt portion 47 of the outer sleeve at opposite sides of the lifting pad 39. The ribs decrease in depth towards the lower end of the tapered portion of the outer sleeve. A web 51 connects the inner and outer sleeve 27 and 29 and extends diametrically from the center of the lifting pad 39 to the inner sleeve 27. The web is continuous from the top wall 25 of the cover to the locking flange 21.

FIGS. 5 through 9 of the drawings shows the invention embodied in a combination tamperproof and child resistant cover 61 which is applied to a container 63. The container 63 is of the conventional aerosol type and is cylindrical in shape. The container is enclosed at its upward end by a domed top wall 65 secured thereto by an upstanding annular rim 67. A valve actuator 69 is mounted on the domed top and is surrounded by an annular collar or mounting cup 71. The annular collar or mounting cup has an undersurface 73 including a peripheral edge 75. The undersurface 73 and edge 75 are spaced above the domed roof.

The cover 61 is formed of a suitable resilient and flexible plastic having memory characteristics such as a polypropylene or an olefin with memory characteristics. The cover may be formed in one piece by a suitable injection molding process.

The cover 61 includes a circular top wall 77 having inner and outer tubular walls or sleeves 79 and 81, respectively, depending therefrom. The inner tubular wall is shorter than the outer tubular wall. An inwardly projecting locking flange or lip 83 is formed at the lower edge of the inner sleeve 79. In this embodiment, the locking flange 83 extends around the entire circumference of the inner sleeve 79. However, it should be understood that the arc of this locking flange may be shortened, if desired. Also, the locking flange may be formed in two or more segments which generally positioned diametrically of each other.

As shown in detail in FIG. 9 of the drawings, the locking flange 83 is formed of trapezoidal cross section having equilateral upper and lower side walls 85 and 87 which connect to the inwardly located apex wall 89 of the trapezoidal locking flange. As can be clearly seen in FIG. 9, the apex wall 89 is not as wide as the base of the locking flange which is formed integrally with the inner sleeve 79. The upper and lower side walls 85 and 87 are inclined at angles of 30° relative to the inner sleeve 79. The 30° angle has been found to work advantageously for a 211 size cover molded of polypropylene. It may be necessary to vary the angles of these walls, especially the angle of the upper side wall 85 for covers of other sizes or which are molded of other materials. However, making the upper side wall 85 too steep, that is, with a smaller angle of inclination relative to the inner sleeve 79 than 30° reduces the holding effect of the cover. If the angle of inclination of the upper side wall 85 is increased, then the difficulty of removing the cover increases. Further, good molding practices require that the angles of inclination of the upper and lower side walls 85 and 87 be substantially identical.

The inward projection of the locking flange 83 should be sufficient that it extends under the undersurface 73 of the mounting cup 71 and of course, inside of the peripheral outer edge 75 of the mounting cup undersurface. The actual amount of projection of the locking flange relative to the undersurface 73 will vary in accordance with the diameter of the locking cup and with the material used to mold the cover 61.

A lifting pad 95 is formed integrally on the outer surface of the outer sleeve 81. The lifting pad includes a lifting surface 97 at the base of the pad which surface is located above the lower edge of the outer sleeve. A circumferentially extending flange 99 is formed integrally with and on the outer surface of the outer sleeve 81. The flange 99 includes a planar undersurface 101 which extends perpendicular to the surface of the outer sleeve and is located on the same plane as the lifting surface 97 of the lifting pad. A skirt portion 103 of the outer sleeve extends below the surfaces 97 and 101 and is tapered to the lower end of the outer sleeve. Inverted generally L-shaped ribs 105 are formed integrally on the outer surface of the skirt portion 103 of the outer sleeve at opposite sides of the lifting pad 95. The ribs decrease in depth towards the lower end of the tapered portion of the outer sleeve.

The combination tamperproof and child resistant cover 61 of the invention shown in FIGS. 5 through 9 of the drawings, can be firmly attached to a container, such as an aerosol container 63, in an automatic capping operation. After the cover is originally removed from the container, it may be reinstalled to function in the manner of a child resistant safety cover. This change in function occurs because the initial removal of the cover results in the peripheral outer edge 75 of the undersurface 73 of the mounting cup 71 removing a portion of the inwardly projecting locking flange 83. The removal of a portion of the locking flange reduces the difficulty of removing the cover from a container but does not render the cover so easy to remove that a child could ordinarily do so. The initial removal of the cover from the container appears to result in the peripheral outer edge 75 of the mounting cup 71 removing a portion of the upper wall 85 of the locking flange 83. However, the amount and location of locking flange actually removed depends to some extent on the amount of the overlap between the locking flange and the undersurface 73 of the mounting cup. As the amount of overlap increases, a greater portion of the locking flange will be removed upon the initial removal of the container.

When originally installed on a container, the tamperproof cover 61 is tightly held by engagement of its locking flange 83 with the undersurface 73 of the mounting cup 71 of the container. The cover is so securely held that it can only be removed through the use of an elongated implement such as a screwdriver. To remove the cover, the elongated implement is inserted under the lifting flange 75 and the implement is pivoted on the rim 67 of the container in order to pry the cover from the container. The locking engagement between the locking flange 83 and the undersurface 73 of the mounting cup 71 can be made sufficiently strong that the cover cannot be removed through the use of a coin or key. Thus, the ordinary prospective purchaser in a store who would normally not be carrying a screwdriver will not be able to remove the cover from the container prior to purchase.

The webs 107 which connect the inner and outer sleeves 79 and 81 transmit removal forces applied by the removal implement from the outer sleeve to the inner sleeve. The webs 107 function to prevent distortion and separation of the outer sleeve relative to the inner sleeve during removal. Although it would be expected that a plurality of webs uniformly located between the inner and outer sleeves would resist distortion of the locking flange and interfere with removal of the cover, this is not the situation because of the unusual construction of the locking flange of this invention. Because a portion of the locking flange is cut away by the peripheral outer edge 75 of the undersurface of the mounting cap 71 during initial removal of the cover from a container, the inability of the locking flange to distort by outward radial movement does not prevent release of the cover and does not result in the fracture of the locking flange. The webs 107 are available after initial removal for the purpose of transferring removal forces from the outer sleeve to the locking flange 83 of the inner sleeve. This permits the cover to function as a child resistant cover. However, before a portion of the locking flanges is removed, the engagement between the locking flange and the undersurface of the mounting cup 71 of the container is so strong that pressure alone applied to the flange through the outer wall 81 and webs 107 of the cover will not bring about removal of the cover from the container. For this reason, the cover 61 functions as a tamperproof cover until it is first removed from a container using a suitable implement. Afterwards, it functions as a child resistant cover which can be removed by squeezing and manipulation.

I claim:

1. A removable and replaceable tamperproof cover for a container having a cylindrical mounting cup with a peripheral undersurface defined by a peripheral outer edge located near the outlet end of the container, said cover including:

a top wall, a relatively thin flexible outer sleeve depending from said top wall, a relatively thin flexible inner sleeve generally coaxial with said outer sleeve and also depending from said top wall, an inwardly projecting locking flange carried by said inner sleeve, said locking flange being generally trapezoidal in cross section with the longer base of the flange formed integrally with the inner sleeve and the shorter end of the flange extending inwardly of the peripheral outer edge and under the peripheral undersurface of the container mounting cup when the cover is initially installed on the container, said locking flange and said peripheral outer edge of the container mounting cup being located relative to each other in said installed position of the cover so that at least a portion of the locking flange is removed by said peripheral outer edge when the cover is removed for the first time from the container, said locking flange being formed and adapted so that the portion thereof remaining after initial removal of the cover provides sufficient engagement with the container mounting cup upon re-installation of the cover on the container that the cover cannot readily be removed by a child but requires squeezing and manipulation ordinarily beyond the ability of a child for removal, a lifting pad located on the outer surface of the outer sleeve and having a lifting surface located above the lower edge of the outer sleeve, and at least one web connecting said inner and outer sleeves with said at least one web being located adjacent said lifting pad and forming a connection between the inner and outer sleeves.

2. The tamperproof cover of claim 1 in which said trapezoidal shaped locking flange is formed with equilateral side walls.

3. The tamperproof cover of claim 2 in which said equilateral side walls each extend at an included angle of approximately 30° relative to the inner sleeve.

4. The tamperproof cover of claim 1 in which ribs are positioned on opposite sides of said lifting pad and extend downwardly from the lifting surface of said lifting pad to the lower edge of said outer sleeve.

5. The tamperproof cover of claim 1 in which an outwardly projecting flange is carried on said outer sleeve and extends at least part way around the periphery of said sleeve, said flange having a lower surface which is aligned with the lifting surface of said lifting pad.

6. The tamperproof cover of claim 1 in which said inner sleeve has an inner diameter less than the outer diameter of said cylindrical surface to provide an interference fit between the inner sleeve of said cover and said container.

* * * * *